US007641300B2

(12) United States Patent
Mataki

(10) Patent No.: US 7,641,300 B2
(45) Date of Patent: Jan. 5, 2010

(54) LIQUID EJECTION HEAD AND IMAGE FORMING APPARATUS

(75) Inventor: Hiroshi Mataki, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 278 days.

(21) Appl. No.: 11/709,193

(22) Filed: Feb. 22, 2007

(65) Prior Publication Data

US 2007/0200882 A1 Aug. 30, 2007

(30) Foreign Application Priority Data

Feb. 24, 2006 (JP) ..... 2006-049173

(51) Int. Cl.
*B41J 29/38* (2006.01)

(52) U.S. Cl. ..... 347/9

(58) Field of Classification Search ..... 347/9
See application file for complete search history.

(56) References Cited

U.S. PATENT DOCUMENTS 5,754,204 A 5/1998 Kitahara
6,402,282 B1 * 6/2002 Webb ..... 347/15

FOREIGN PATENT DOCUMENTS

JP 8-290571 A 11/1996

* cited by examiner

*Primary Examiner*—Julian D Huffman
(74) *Attorney, Agent, or Firm*—Birch, Stewart, Kolasch & Birch, LLP

(57) ABSTRACT

The liquid ejection head has an ejection unit which includes: a nozzle ejecting a droplet of liquid; a pressure chamber connected to the nozzle; a displacement generating device which changes a volume of the pressure chamber; and a supply flow channel which is connected to the pressure chamber and supplies the liquid to the pressure chamber, wherein a resonance frequency f (kHz) of the ejection unit and an ejection speed v (m/s) of the droplet ejected by the nozzle satisfy a following relationship: $f>31\times v+80$.

3 Claims, 13 Drawing Sheets

| EJECTION SPEED [m/s] | RESONANCE FREQUENCY [kHz] |
|---|---|
| 3.8 | 200 |
| 5.5 | 250 |
| 7 | 300 |

FIG.4

| EJECTION SPEED [m/s] | RESONANCE FREQUENCY [kHz] |
|---|---|
| 3.8 | 200 |
| 5.5 | 250 |
| 7 | 300 |

FIG.6

ACTUATOR

| | |
|---|---|
| PRESSURE GENERATED | 2MPa |
| ELIMINATION VOLUME | 10pl |

NOZZLE

| | |
|---|---|
| DIAMETER ($\phi$Nz) | 20 $\mu$m |
| LENGTH (Lnz) | 20 $\mu$m |

PRESSURE CHAMBER

| | |
|---|---|
| LENGTH (Lc) | 1000 $\mu$m |
| WIDTH (Wc) | 100 $\mu$m |
| HEIGHT (Hc) | 100 $\mu$m |

SUPPLY PORT

| | |
|---|---|
| LENGTH (Ls) | 20 $\mu$m |
| WIDTH (Ws) | 50 $\mu$m |
| HEIGHT (Hs) | 50 $\mu$m |

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a composition of a liquid ejection head which is suitable for an inkjet recording head, or the like, which changes a volume of a pressure chamber by driving a piezoelectric element in order to eject a liquid droplet, and to an image forming apparatus using same.

2. Description of the Related Art

In an inkjet recording head using piezoelectric elements, it is necessary to control the driving of the piezoelectric elements in consideration of the Helmholtz resonance frequency of the pressure chambers. For example, Japanese Patent Application Publication No. 8-290571 discloses that ink droplets having a virtually spherical shape are generated by using an inkjet recording head in which the inertance Mn of a nozzle aperture and the inertance Ms of the ink supply aperture satisfies "Mn/(Mn+Ms)>0.5". Moreover, Japanese Patent Application Publication No. 8-290571 proposes that high-speed driving is achieved by setting the contraction time of a piezoelectric oscillator for suctioning ink into a pressure generating chamber (pressure chamber), and the expansion time of the piezoelectric element for ejecting an ink droplet from the nozzle aperture, to 1/f (where f is the Helmholtz resonance frequency). The residual vibration of the meniscus is thus reduced as far as possible.

However, Japanese Patent Application Publication No. 8-290571 refers only to the inertance ratio (Mn/(Mn+Ms)) and the Helmholtz resonance frequency, and it does not refer to the ejection speed for ejecting liquid droplets. In general, when ejection force is enlarged, not only does the ejection speed of the ejected liquid droplet (main droplet) increase accordingly, but also a large number of satellite droplets are generated.

Since these satellite droplets cause image deterioration, then the occurrence of a large number of satellite droplets is not desirable from the viewpoint of image quality. In Japanese Patent Application Publication No. 8-290571, the occurrence of satellite droplets is not considered, and there is a possibility that image quality may deteriorate due to the occurrence of a large number of satellite droplets.

SUMMARY OF THE INVENTION

The present invention has been contrived in view of foregoing circumstances, an object thereof being to provide a liquid ejection head and an image forming apparatus using same whereby the occurrence of satellite droplets can be prevented.

In order to attain the aforementioned object, the present invention is directed to a liquid ejection head comprising an ejection unit which includes: a nozzle ejecting a droplet of liquid; a pressure chamber connected to the nozzle; a displacement generating device which changes a volume of the pressure chamber; and a supply flow channel which is connected to the pressure chamber and supplies the liquid to the pressure chamber, wherein a resonance frequency f (kHz) of the ejection unit and an ejection speed v (m/s) of the droplet ejected by the nozzle satisfy a following relationship: $f>31\times v+80$.

In a liquid ejection head according to the present invention, a unit of ejection element (an ejection unit corresponding to a single channel) can be understood as a system including a nozzle, a pressure chamber connected to the nozzle, a displacement generating device which causes a volume change in the pressure chamber, and a supply flow channel which supplies liquid to the pressure chamber. In this ejection unit, liquid flows into and fills the pressure chamber through the supply flow channel and the displacement generating device is driven, and thereby a volume change (pressure change) in the pressure chamber is caused. A pressure change thus created causes a liquid droplet to be ejected from the nozzle.

According to this aspect of the present invention in particular, from the viewpoint of preventing the occurrence of satellite droplets in ejection operation, the relationship, $f>31\times v+80$, is satisfied as a condition for preventing the occurrence of satellite droplets, where "f (kHz)" is the resonance frequency of the ejection unit and "v (m/s)" is the ejection speed of the liquid droplet. By satisfying this relationship, it is possible to achieve ejection which is free of satellite droplets (namely, ejection of a main droplet only).

Preferably, the resonance frequency f is not less than 250 (kHz).

The ejection speed and the ejection volume depend on the specific design details of the ejection unit. For example, in cases where the resonance frequency is 250 kHz or above, the ejection speed has a value of approximately 5.5 m/s and the ejection volume (main droplet volume) is 2 pl (picoliters) or below. Thus, high-quality image formation can be achieved in such an inkjet printer.

In order to attain the aforementioned object, the present invention is also directed to an image forming apparatus comprising any of the above-mentioned liquid ejection heads, wherein the nozzle ejects the droplet onto a recording medium in such a manner that an image including the droplet is formed on the recording medium.

An inkjet recording apparatus forming one embodiment of the image forming apparatus according to the present invention includes a liquid ejection head (a recording head) which has a plurality of liquid droplet ejection elements (ejection units) arranged at high density. Each ejection element includes: a nozzle forming an ejection port for ejecting a liquid droplet of ink in order to form a dot; a piezoelectric actuator (displacement generating device) which generates a volume change in the pressure chamber connected to the nozzle; and an ink supply channel (supply flow channel) leading to the pressure chamber. Furthermore, the inkjet recording apparatus also comprises an ejection control device which controls the ejection timing and ejection volume for each nozzle by controlling the driving of the piezoelectric actuator corresponding to each nozzle, on the basis of ink ejection data (dot image data) generated from the input image. The inkjet recording apparatus forms an image by liquid droplets ejected from the nozzle.

One compositional embodiment of a liquid ejection head for printing of this kind is a full line type head in which a plurality of nozzles are arranged through a length corresponding to the full width of the recording medium. A full line type head is usually disposed so as to extend in a direction that is perpendicular to the relative feed direction (relative conveyance direction) of the recording medium, but a mode may also be adopted in which the head follows an oblique direction that forms a prescribed angle with respect to the direction perpendicular to the conveyance direction.

In forming color images by means of an inkjet liquid ejection head (print head), it is possible to provide heads according to colors of a plurality of colored inks, or it is possible to eject inks of a plurality of colors, from one head.

The "recording medium" is a medium on which liquid ejected from a nozzle of the liquid ejection head is deposited. With respect to an image forming apparatus, the examples of the recording medium include various media such as recording paper. The term "recording medium" includes print medium, image forming medium, image recording medium, image receiving medium, ejection receiving medium, and the like. The term "recording medium" includes various types of media, irrespective of material and size, such as continuous paper, cut paper, sealed paper, resin sheets such as OHP sheets, film, cloth, a printed circuit board on which a wiring pattern, or the like, is formed, and an intermediate transfer medium, and the like.

The movement device for causing the recording medium and the liquid ejection head to move relatively to each other includes a mode where the recording medium is conveyed with respect to a stationary (fixed) head, a mode where a head is moved with respect to a stationary recording medium, and a mode where both the head and the recording medium are moved.

Furthermore, the present invention is not limited to a full line head as described above, and it may be applied to a method, such as a shuttle scanning method, which carries out recording by scanning a recording head of a length shorter than the page width of the recording medium, a plurality of times.

According to the present invention, it is possible to perform ejection without generating satellite droplets.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 4 is a table showing conditions at the measurement points shown in FIG. 3;

FIG. 6 is a diagram showing an example of design conditions for the ejection unit shown in FIG. 5;

DETAILED DESCRIPTION OF THE PREFERRED EMBODIMENTS

Derivation of Conditions which Prevent Generation of Satellite Droplets

In order to suppress the occurrence of satellite droplets in liquid ejection, ejection speed of liquid droplets needs to be restricted to a prescribed value or below. Simulation analyses were conducted from this viewpoint, and conditions for achieving satellite-free ejection were derived from the simulation analyses.

Figure 1:
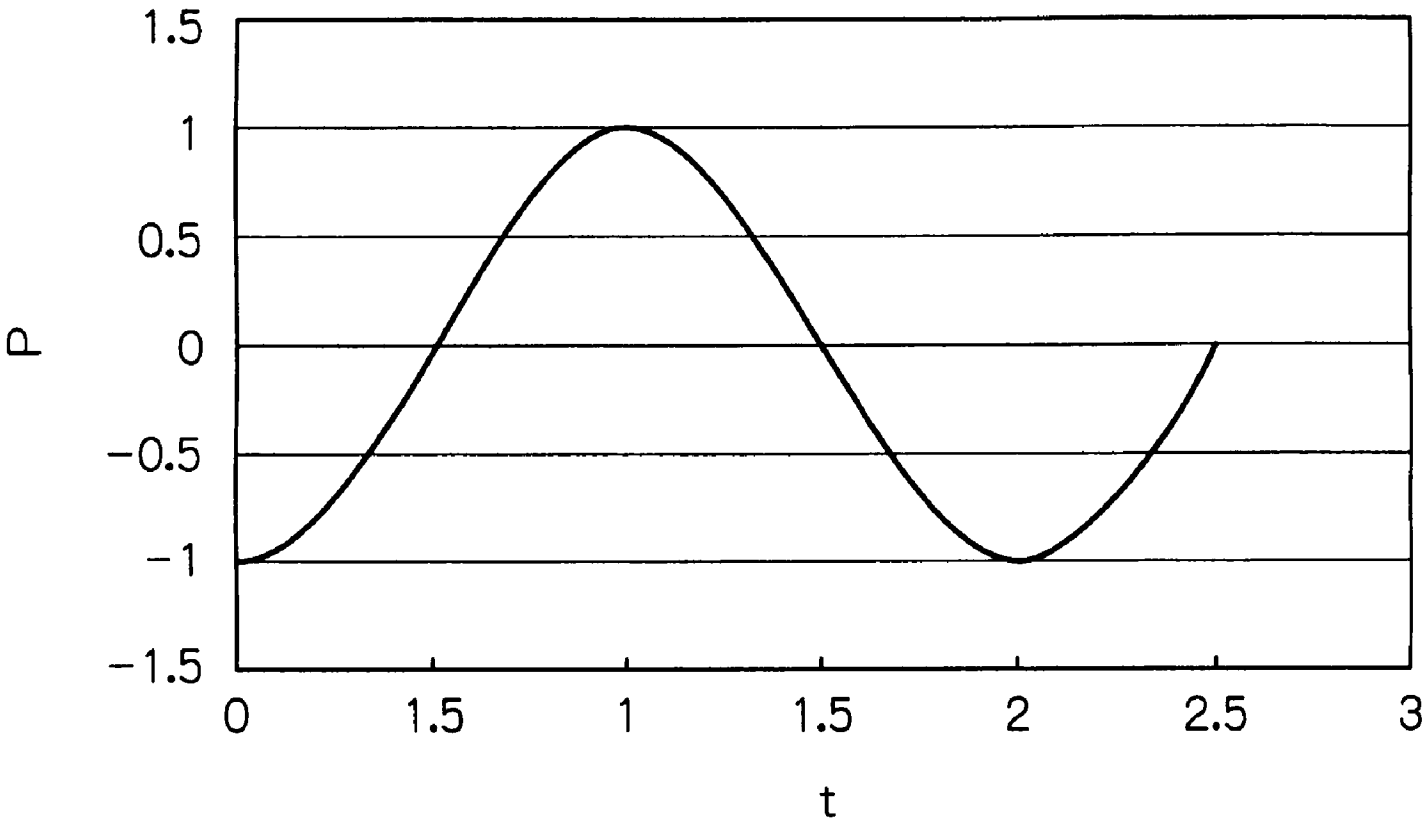
FIG. 1 is a waveform diagram showing an embodiment of a waveform of a pressure variation applied to a nozzle section of a CFD (computational fluid dynamics) model.

In other words, conditions under which no satellite droplets occur were determined by carrying out simulation analyses where the pressure variation applied to the nozzle section of the ejection unit was used as the boundary condition. The pressure change applied to the nozzle section has the waveform shown in FIG. 1, and it is described by the following equation:

$$P=-\cos(2\pi ft)\times \mathrm{step}[(2.5/f)-t] \quad (1).$$

Figure 2:
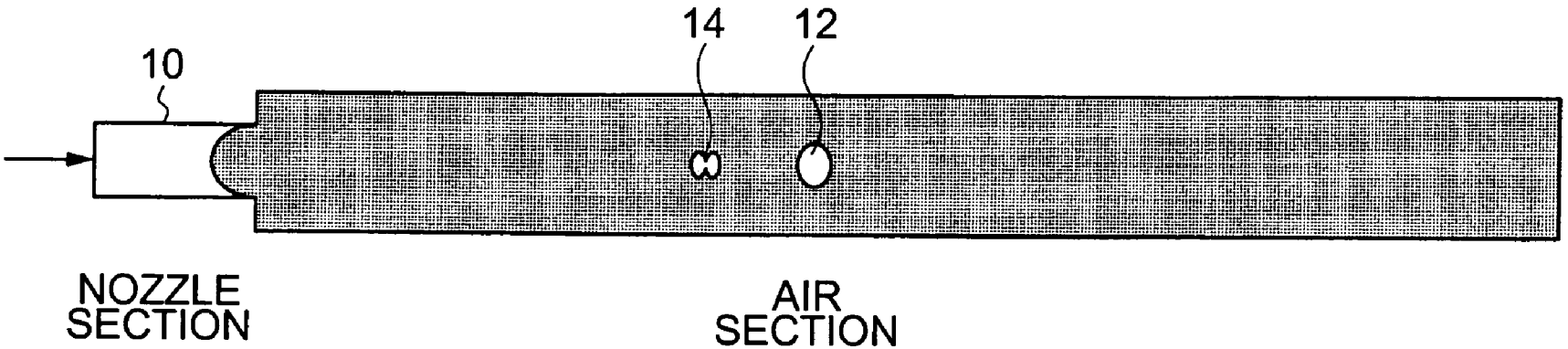
FIG. 2 is a diagram showing an example of simulation results in a situation where a satellite droplet has occurred.

This pressure change was introduced into the nozzle section (which is indicated by the arrow in FIG. 2) of a CFD (Computational Fluid Dynamics) model shown in FIG. 2, and the results of the simulation analyses were observed on the computer display screen. The term "pressure change frequency" indicates the frequency of the pressure variation in the graph shown in FIG. 1.

Method of Evaluating Simulation Results

The presence or absence of satellite droplets (whether a satellite droplet was ejected or not) was determined by observing the simulation results and counting the number of liquid droplets ejected into the air section from the tip (aperture section) of the nozzle. In the example shown in FIG. 2, a main droplet 12 and satellite droplets 14 are ejected from the nozzle 10 towards the air section. The mass of liquid ejected from the nozzle section into the air section during the simulation experiment was calculated and then divided by the density of the liquid (1000 kg/m$^3$), thereby obtaining the volume of the liquid droplets.

The number of satellite droplets was calculated by the formula: "the number of liquid droplets observed in simulation results minus one (i.e. "the number of liquid droplets observed in simulation results"−1)". In other words, the number of satellite droplets was calculated by subtracting the number (i.e., one) of the main droplet from the total number of liquid droplets observed.

Figure 3:
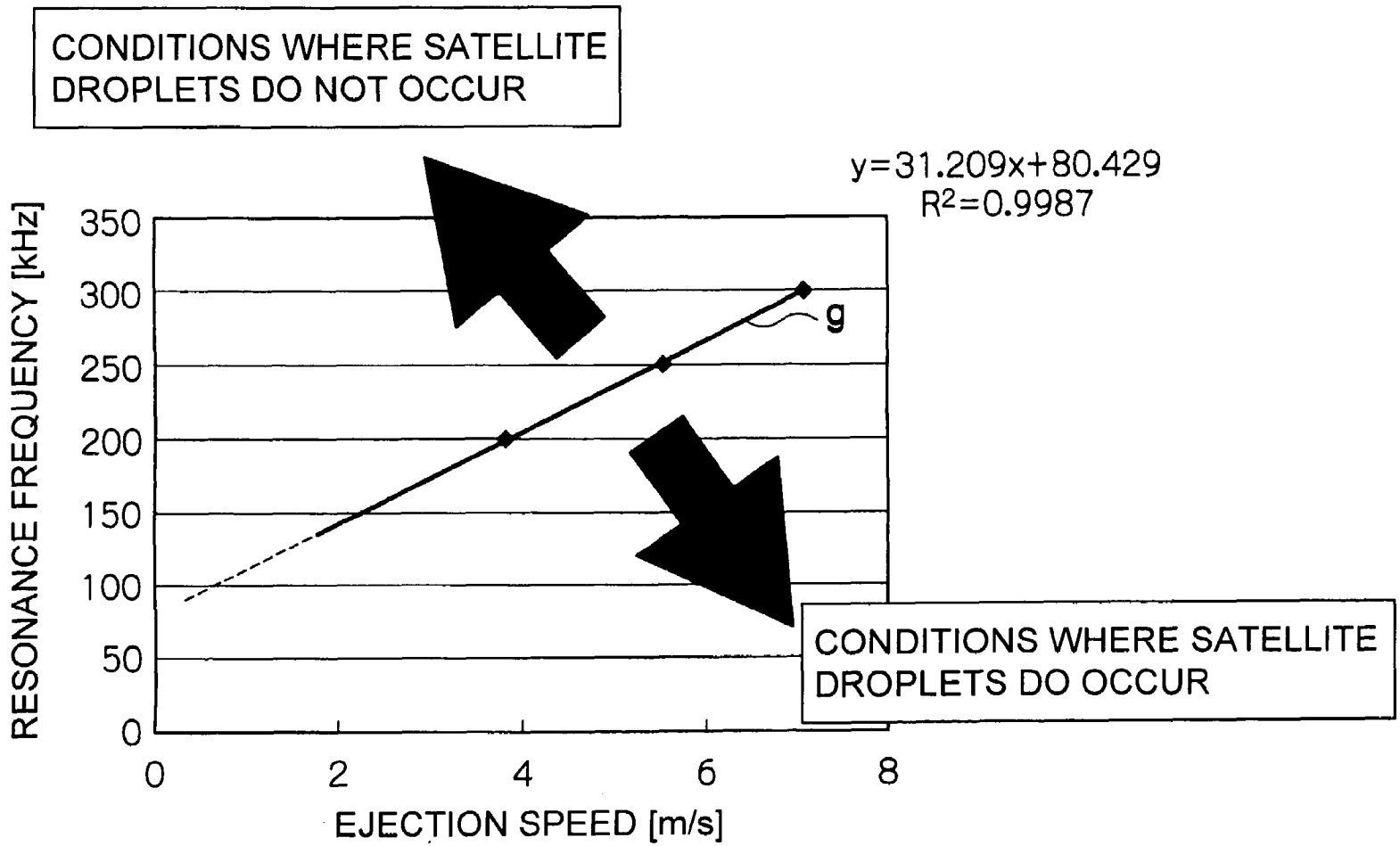
FIG. 3 is a graph showing the relationship between the resonance frequency and the ejection speed at which satellite droplets do not occur.

FIG. 3 is a diagram showing the relationship between the resonance frequency and the ejection speed at which satellite droplets do not occur. It was judged whether or not the satellite droplets were generated, on the basis of the simulation results displayed on the screen. FIG. 3 shows conditions of the minimum ejection speed (the limit value of the ejection speed for avoiding occurrence of satellite droplets) at which only a main droplet is ejected without the occurrence of satellite droplets.

In FIG. 3, the horizontal axis represents the ejection speed (m/sec), and the vertical axis represents the resonance frequency (kHz). Here, the "resonance frequency" means the resonance frequency of the ejection unit (recording element unit) based on the existence of the liquid, the actuator, and the rigidity of the pressure chamber. The resonance frequency depends on the design of the head. As described in Japanese Patent Application Publication No. 8-290571, the Helmholtz frequency f of the pressure chamber can be expressed as:

$$f = \frac{1}{2\pi} \times \sqrt{(Mn + Ms)/(Ci + Cv) \cdot (Mn \times Ms)}, \quad (2)$$

where Ci is the compliance due to the compressibility of the ink inside the pressure chamber; Cv is the compliance due to the rigidity of the actual material of the members forming the pressure chambers (e.g. the diaphragm, the flow channel forming plate, the nozzle plate, and the like); Mn is the inertance of the nozzle aperture; and Ms is the inertance of the ink supply port.

In this case, the compliance Ci can be expressed as: $Ci=V/\rho c$, where V is the volume of the pressure chamber; ρ is the ink density; and c is the speed of sound in the ink. Moreover, the compliance Cv due to the rigidity of the pressure chamber is equal to the static deformation ratio when the unit pressure is applied to the pressure chamber.

The conditions at the three points indicated by black diamond symbols in the graph illustrated in FIG. 3 are shown in the table illustrated in FIG. 4. As shown in FIG. 4, at a resonance frequency of 200 kHz, the limit (lower limit) of the ejection speed at which satellite droplets do not occur was 3.8 m/s, and if the ejection speed becomes greater than this value, then satellite droplets occurred.

Furthermore, at a resonance frequency of 250 kHz, the limit (lower limit) of the ejection speed at which satellite droplets do not occur was 5.5 m/s. At a resonance frequency of 300 kHz, the limit (lower limit) of the ejection speed at which satellite droplets do not occur was 7 m/s.

An approximation represented by the straight line "g" in FIG. 3 derived from these three points can be expressed as follows:

$$y=31.209x+80.429 \quad (3).$$

The coefficient of determination, $R^2$, for evaluating the result of the approximation has a value of 0.9987 (i.e. $R^2=0.9987$), which means that the approximation accuracy is good.

By rounding the fractions (fractional part after the decimal point) in the numerical values (coefficients) "31.209" and "80.429" in Formula (3) to the nearest integer (by counting fractions of 0.5 and over as a unit and cutting away the rest of the numerical values), Formula (3) is expressed by $$y=31x+80 \quad (4).$$

Although the approximation accuracy is reduced by rounding the fractions, no substantial problem arises if it is assumed that this Formula (4) expresses the straight line g.

As shown in FIG. 3, the region above the approximate straight line g corresponds to conditions where satellite droplets do not occur, whereas the region below the approximate straight line g corresponds to conditions where satellite droplets do occur. Under ejection conditions within the region above the approximate straight line g, it is possible to prevent the occurrence of satellite droplets.

In other words, in order to prevent the occurrence of the satellite droplets, the following relationship needs to be satisfied:

$$f>31\times v+80 \quad (5),$$

where f (kHz) is the resonance frequency and v (m/s) is the ejection speed.

In cases of the resonance frequency of 250 kHz or greater, the ejection speed can have a value of 5.5 m/s, and the ejection volume can become 2 picoliters (2 pl) or less. Therefore, the inkjet printer can form images of high quality.

Figure 5:
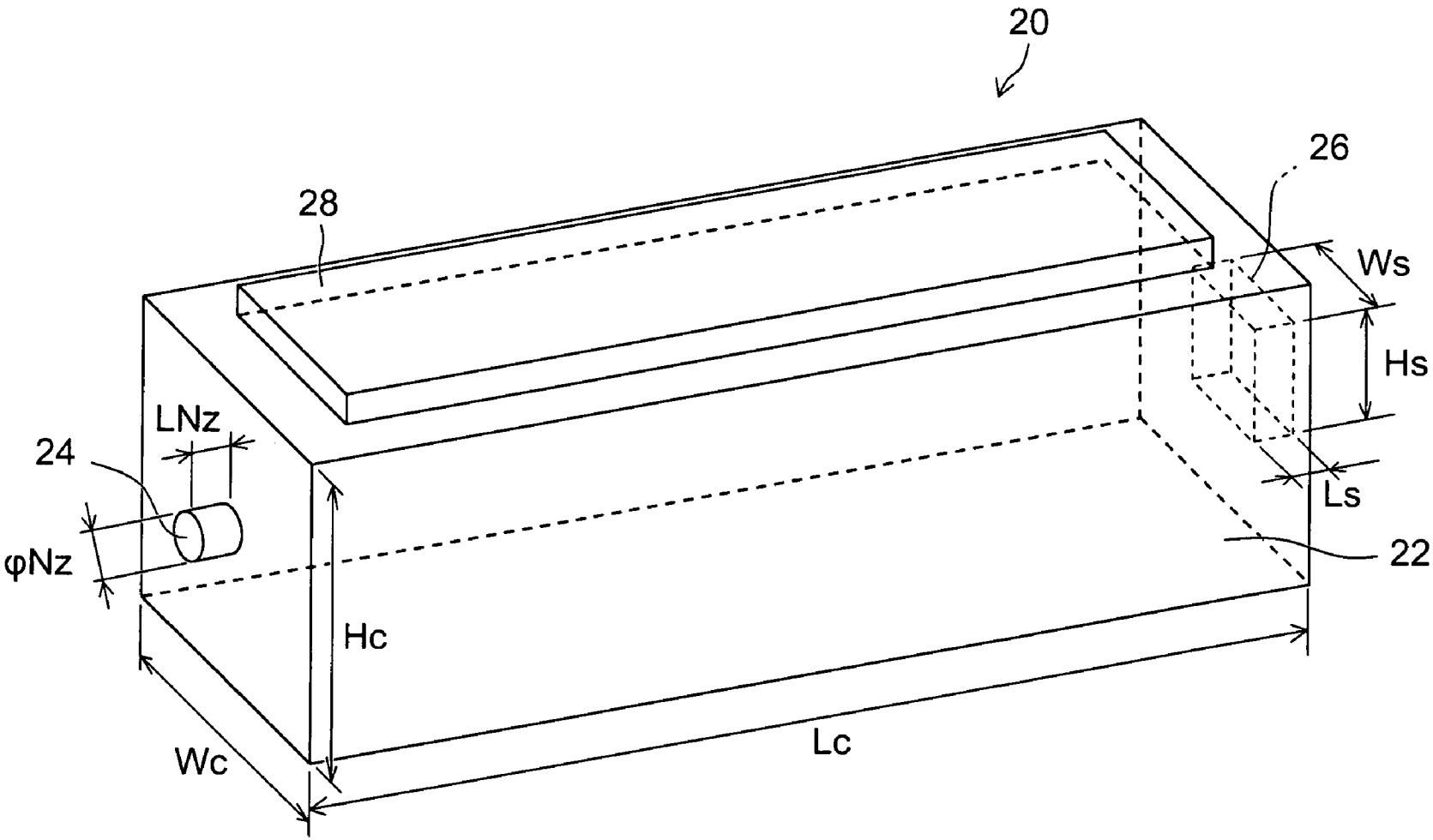
FIG. 5 is a schematic drawing showing an embodiment of the composition of an ejection unit.

FIGS. 5 and 6 show a design embodiment of an ejection unit which satisfies these conditions. FIG. 5 is an oblique diagram showing a schematic embodiment of the structure of an ejection unit 20 which corresponds to one nozzle of a liquid ejection head (namely, a liquid droplet ejection element corresponding to one channel). The reference numerals 22, 24, 26, and 28 respectively denote a pressure chamber, a nozzle, a supply port (which corresponds to a "supply flow channel"), and an actuator (which corresponds to a "displacement generating device"). By arranging a plurality of the ejection units 20 shown in FIG. 5 in an one-dimensional or two-dimensional configuration, a liquid ejection head having a plurality of nozzles is formed. Each supply port 26 is connected to a common flow channel (common liquid chamber), which is not shown in FIG. 5.

An embodiment of conditions of an actuator 28 and the dimensions of a nozzle, a pressure chamber, and a supply port, is shown in the table in FIG. 6. Lc is the length of the pressure chamber 22 in the ejection unit 20 shown in FIG. 5; Wc is the width of the pressure chamber 22; Hc is the height of the pressure chamber 22; ϕNZ is the diameter of the nozzle 24; Lnz is the length of the nozzle 24; Ls is the length of the supply port 26; Ws is the width of the supply port 26; and Hs is the height of the supply port 26.

The ejection unit 20 shown in FIGS. 5 and 6 is one embodiment which satisfies the relationship expressed by Formula (5), and there are many other modes of the ejection unit apart from the structure shown in FIG. 5. In other words, it is possible to adopt many different designs, in terms of the shape and size of the pressure chamber, the nozzle position with respect to the pressure chamber, the position of the supply port with respect to the pressure chamber, the flow channel shape of the nozzle, the flow channel shape of the supply port, the actuator shape, the actuator position with respect to the pressure chamber, and the like, as long as the conditions described above are satisfied.

Embodiment of Application to Inkjet Recording Apparatus

Next, an embodiment of an image forming apparatus using a liquid ejection head 10 having ejection units each of which satisfies the relationship expressed by Formula (5) described above, is described below.

Figure 7:
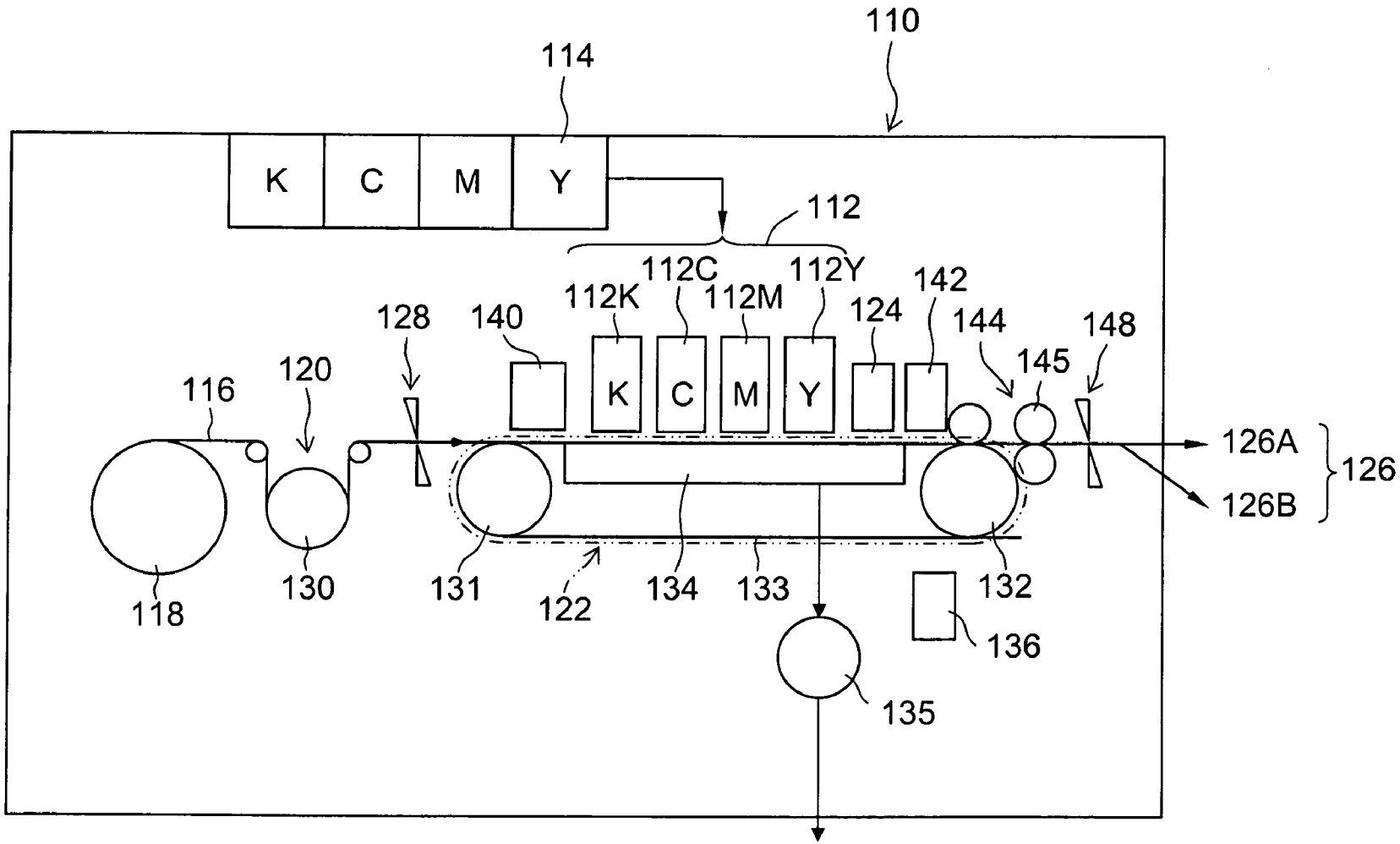
FIG. 7 is a general schematic drawing showing an inkjet recording apparatus which forms one embodiment of an image forming apparatus according to the present invention.

FIG. 7 is a general configuration diagram of an inkjet recording apparatus showing an embodiment of an image forming apparatus according to the present invention. As shown in FIG. 7, the inkjet recording apparatus 110 comprises: a print unit 112 having a plurality of inkjet heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the print unit 112, for conveying the recording paper 116 while keeping the recording paper 116 flat; a print determination unit 124 for reading the printed result produced by the print unit 112; and a paper output unit 126 for outputting image-printed recording paper (printed matter) to the exterior.

For each of the heads 112K, 112C, 112M, and 112Y of the print unit 112, a liquid ejection head having ejection units each of which satisfies the relationship expressed by Formula (5) is used.

The ink storing and loading unit 114 shown in FIG. 7 has ink tanks for storing the inks of K, C, M, and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 7, a magazine for rolled paper (continuous paper) is shown as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of media is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 7, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the print unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the print unit 112 on the interior side of the belt 133, which is set around the rollers 131 and 132, as shown in FIG. 7. The suction chamber 134 provides suction with a fan 135 to generate a negative pressure, and the recording paper 116 is held on the belt 133 by suction. It is also possible to employ an electrostatic method, instead of the suction method.

The belt 133 is driven in the clockwise direction in FIG. 7 by the motive force of a motor (not shown in drawings) being transmitted to at least one of the rollers 131 and 132, around which the belt 133 is set, and the recording paper 116 held on the belt 133 is conveyed from left to right in FIG. 7.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, examples thereof include: a configuration in which the belt 133 is nipped with cleaning rollers such as a brush roller and a water absorbent roller; an air blow configuration in which clean air is blown onto the belt 133; and a combination of these. In the case of the configuration in which the belt 133 is nipped with the cleaning rollers, it is preferable to make the line velocity of the cleaning rollers different than that of the belt to improve the cleaning effect.

The inkjet recording apparatus 110 can comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 8:
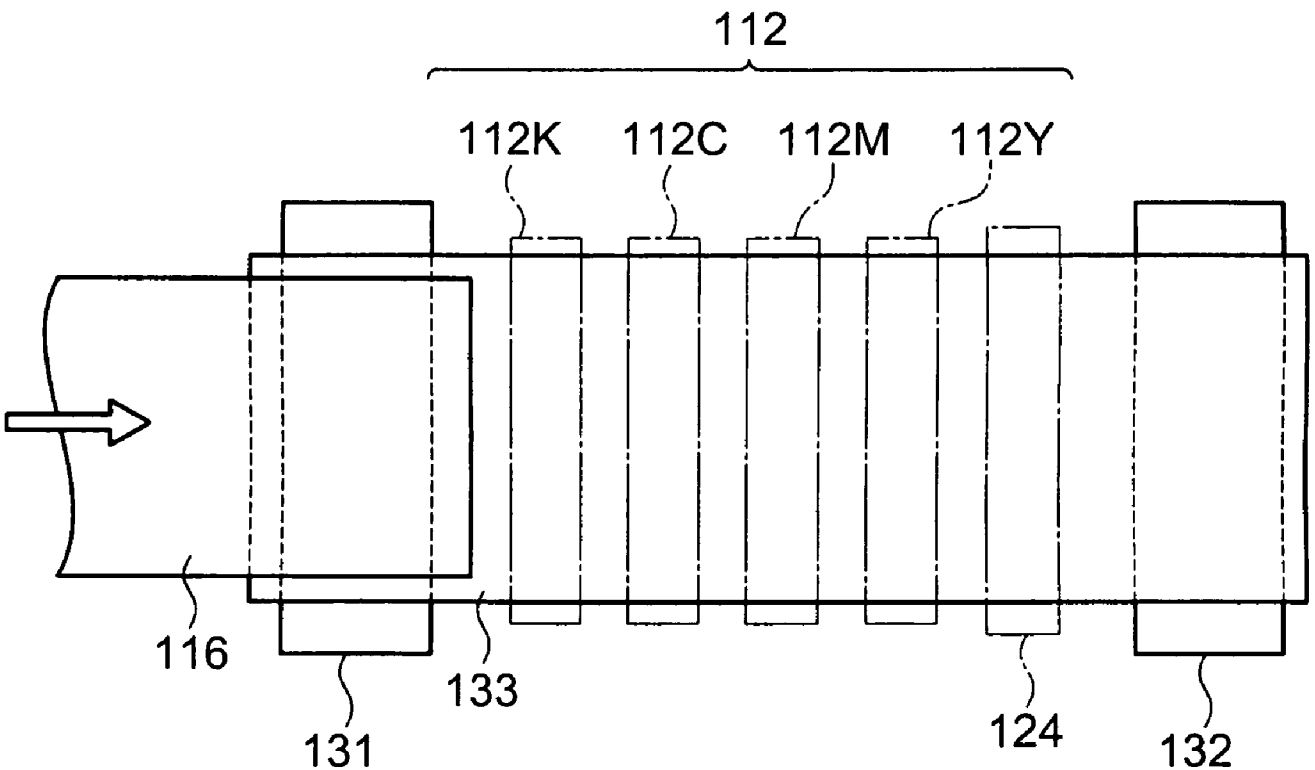
FIG. 8 is a principal plan diagram of the peripheral area of a print unit in the inkjet recording apparatus shown in FIG. 7.

The heads 112K, 112C, 112M, and 112Y of the print unit 112 are full line heads each of which has a length corresponding to the maximum width of the recording paper 116 to be used in the inkjet recording apparatus 110, and each of which comprises a plurality of nozzles for ejecting ink arranged on a nozzle face through a length exceeding at least one edge of the maximum-size recording medium (namely, the full width of the printable range) (see FIG. 8).

The print heads 112K, 112C, 112M, and 112Y are arranged in color order (black (K), cyan (C), magenta (M), yellow (Y)) from the upstream side in the feed direction of the recording paper 116, and these heads 112K, 112C, 112M, and 112Y are fixed extending in a direction substantially perpendicular to the conveyance direction of the recording paper 116.

A color image can be formed on the recording paper 116 by ejecting inks of different colors from the heads 112K, 112C, 112M, and 112Y, respectively, onto the recording paper 116 while the recording paper 116 is conveyed by the belt conveyance unit 122.

By adopting a configuration in which the full line heads 112K, 112C, 112M, and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 7 has an image sensor (line sensor or area sensor) for capturing an image of the ink-droplet deposition result of the print unit 112, and functions as a device to check for ejection defects such as clogs of the nozzles and depositing position displacement from the ink-droplet deposition results evaluated by the image sensor. A test pattern or the target image printed by the print heads 112K, 112C, 112M, and 112Y of the respective colors is read in by the print determination unit 124, and the ejection performed by each head is determined. The ejection determination includes detection of the ejection, measurement of the dot size, and measurement of the dot formation position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substances that cause dye molecules to break down, and thereby the effect of increasing the durability of the print can be obtained.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 7, the paper output unit 126A for the target prints is provided with a sorter for collecting prints according to print orders.

Structure of a Head

Next, the structure of a head is described below. The heads 112K, 112C, 112M, and 112Y of the respective ink colors have the same structure, and a reference numeral 150 is hereinafter designated to any of the heads.

Figure 9A:
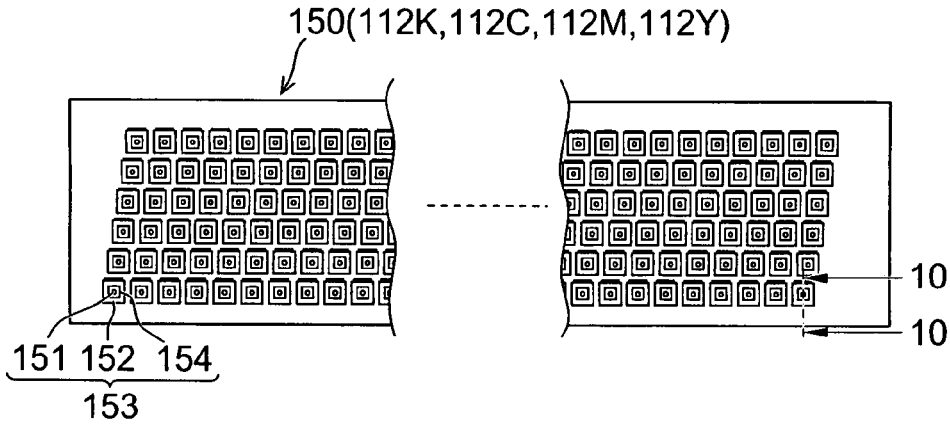
FIG. 9A is a plan view perspective diagram showing an embodiment of the composition of a print head.
Figure 9B:
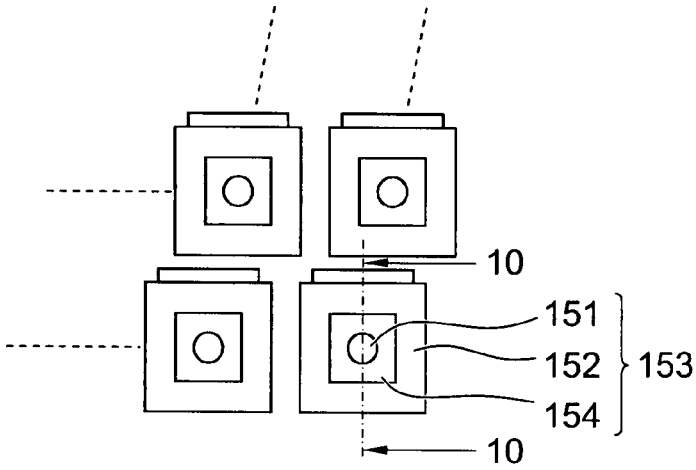
FIG. 9B is a principal enlarged view of FIG. 9A.
Figure 9C:
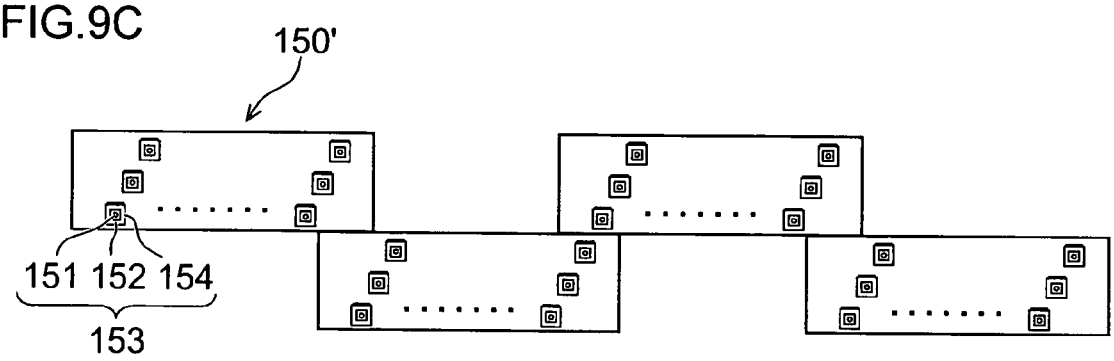
FIG. 9C is a plan view perspective diagram showing a further embodiment of the structure of a full line head.
Figure 10:
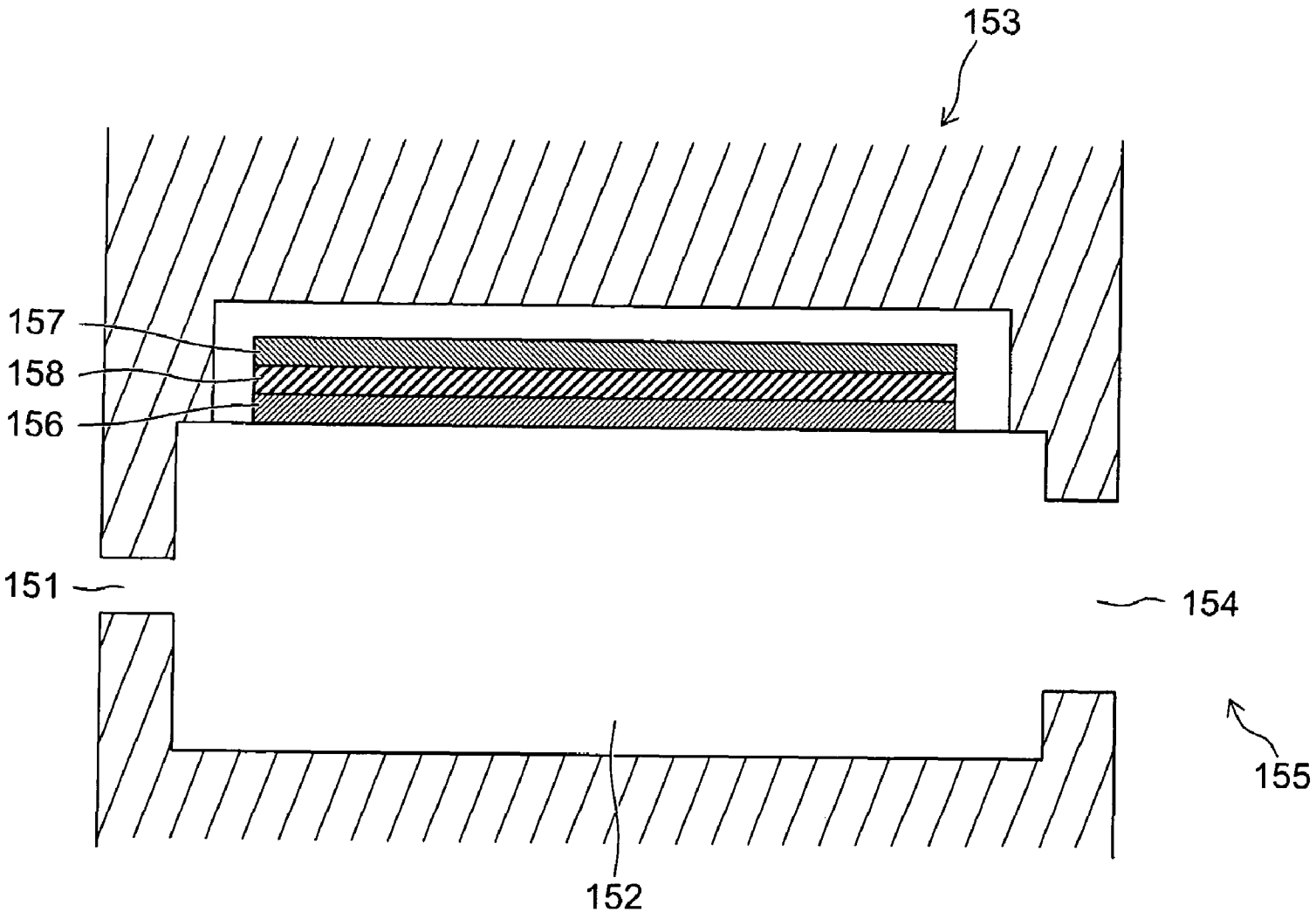
FIG. 10 is a cross-sectional view along line 10-10 in FIGS. 9A and 9B.

FIG. 9A is a perspective plan view showing an embodiment of the configuration of the head 150, FIG. 9B is an enlarged view of a main portion thereof, and FIG. 9C is a perspective plan view showing another example of the configuration of the head 150. FIG. 10 is a cross-sectional view taken along the line 10-10 in FIGS. 9A and 9B, showing the three-dimensional structure of an ejection unit 153 (a droplet ejection element constituting a recording element unit) corresponding to one nozzle 151.

As shown in these drawings, the head 150 according to the present embodiment has a structure in which a plurality of ejection units 153 are arranged two-dimensionally in a matrix configuration, each ejection unit 153 being constituted by a nozzle 151 forming an ink ejection port, a pressure chamber 152 connected to the nozzle 151, a supply port 154 for supplying ink to the pressure chamber 152, and an actuator forming a displacement generating device which changes the volume of the pressure chamber 152 (not shown in FIG. 8 and indicated by reference numeral 158 in FIG. 10).

Consequently, nozzle rows extending through a length corresponding to the entire width of the recording paper 116 in a direction substantially perpendicular to the direction of conveyance of the recording paper 116 are formed, and therefore high density is achieved in the effective nozzle interval (projected nozzle pitch) projected to an alignment in the lengthwise direction of the head (the direction perpendicular to the paper conveyance direction).

The mode of composing a full line head is not limited to the mode shown in FIG. 9A in which nozzle rows are formed through a length corresponding to the full width of the recording medium in the direction substantially perpendicular to the conveyance direction of the recording medium, by means of one head. For example, instead of the composition in FIG. 9A, as shown in FIG. 9C, a line head having nozzle rows of a length corresponding to the entire width of the recording medium can be formed by arranging and combining, in a staggered matrix configuration, short head modules 150' each having a plurality of nozzles 151 arrayed in a two-dimensional fashion.

The pressure chamber 152 provided corresponding to each of the nozzles 151 is approximately square-shaped in plan view, and a nozzle 151 is provided in one location at a corner section in the vicinity of an apex of the pressure chamber 152. The ink supply port 154 is provided in the corner section in the vicinity of another apex of the pressure chamber 152, and more desirably, the corner section on the diagonal with respect to the nozzle 151.

The shape of the pressure chamber 152 is not limited to that of the present embodiment and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 10, each pressure chamber 152 is connected to a common flow channel 155 via the supply port 154. The common flow channel 155 is connected to an ink tank (not shown), which is a base tank that supplies ink, and the ink supplied from the ink tank is distributed and delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 10, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to adopt a piezoelectric element using a piezoelectric body, such as lead zirconate titanate, barium titanate, or the like. When the actuator 158 returns to its original position (the displacement of the actuator 158 is removed) after ejecting ink, the pressure chamber 152 is filled with new ink from the common flow channel 155, via the supply port 154.

By controlling the driving of the actuators 158 corresponding to the nozzles 151 in accordance with the dot arrangement data generated from the input image, it is possible to eject ink droplets from the nozzles 151.

Figure 11:
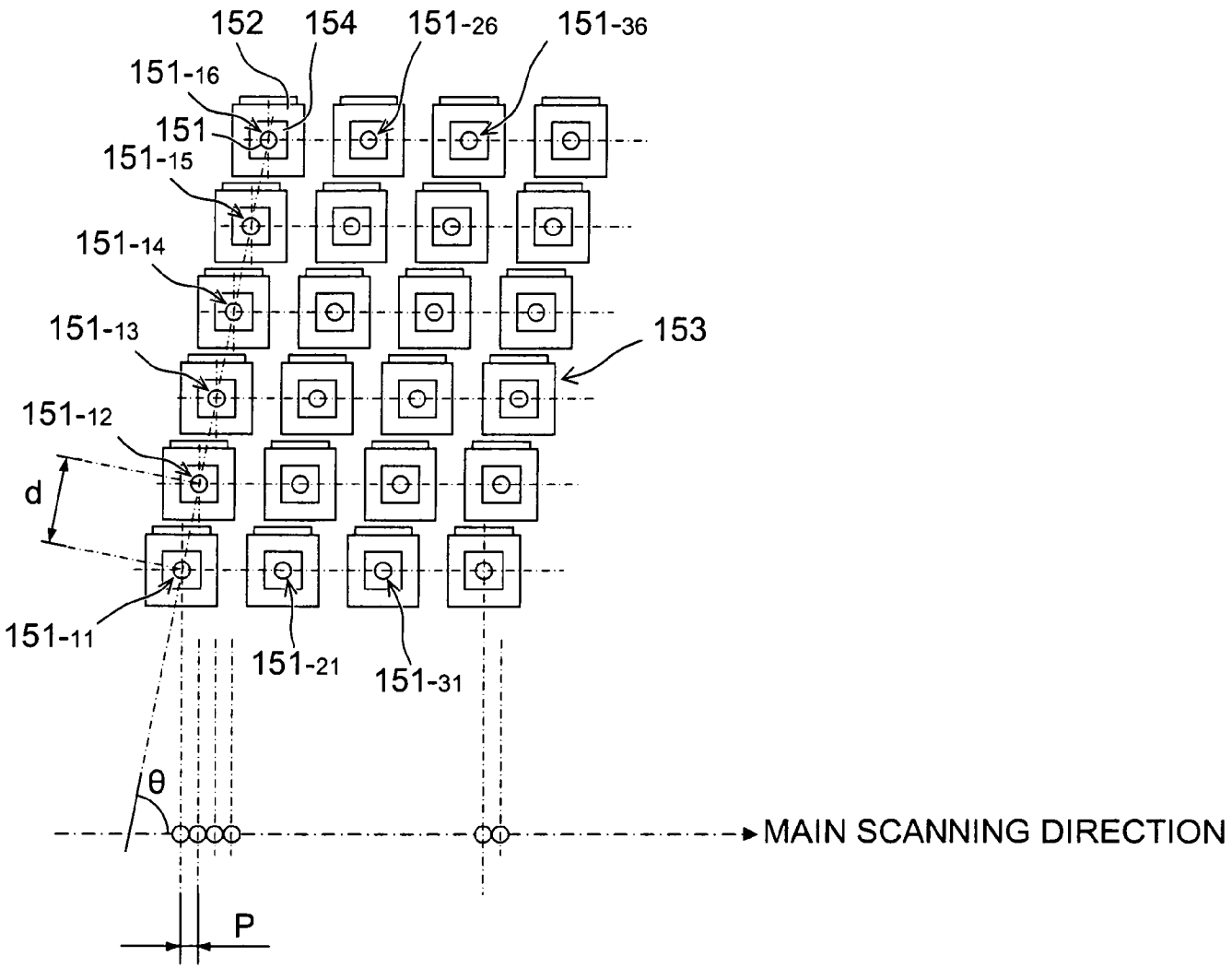
FIG. 11 is an enlarged view showing a nozzle arrangement in the print head shown in FIG. 9A.

As shown in FIG. 11, the high-density nozzle head according to the present embodiment is achieved by arranging a plurality of ejection units 153 having the above-described structure in a matrix fashion (oblique lattice fashion) based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ejection units 153 are arranged at a uniform pitch d in line with a direction forming an angle of θ with respect to the main scanning direction, the pitch P of the nozzles projected so as to align in the main scanning direction is d×cos θ, and hence the nozzles 151 can be regarded to be equivalent to those arranged linearly at a fixed pitch P in the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 11 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording paper 116 is called the sub-scanning direction and the direction perpendicular to same is called the main scanning direction.

As shown in FIG. 7, by controlling the ink ejection timing of the nozzles 151 in accordance with the speed of conveyance of the print medium 116, while conveying the recording paper 116 forming the recording medium in the sub-scanning direction at a uniform speed, it is possible to record a desired image on the print medium 116.

In implementing the present invention, the arrangement of the nozzles is not limited to that of the embodiment shown. Furthermore, in the present embodiment, a composition is described in which six nozzle rows of nozzles 151 aligned in the row direction are arranged in the column direction, but in implementing the present invention, the number n of nozzle rows is not limited to this.

Figure 12:
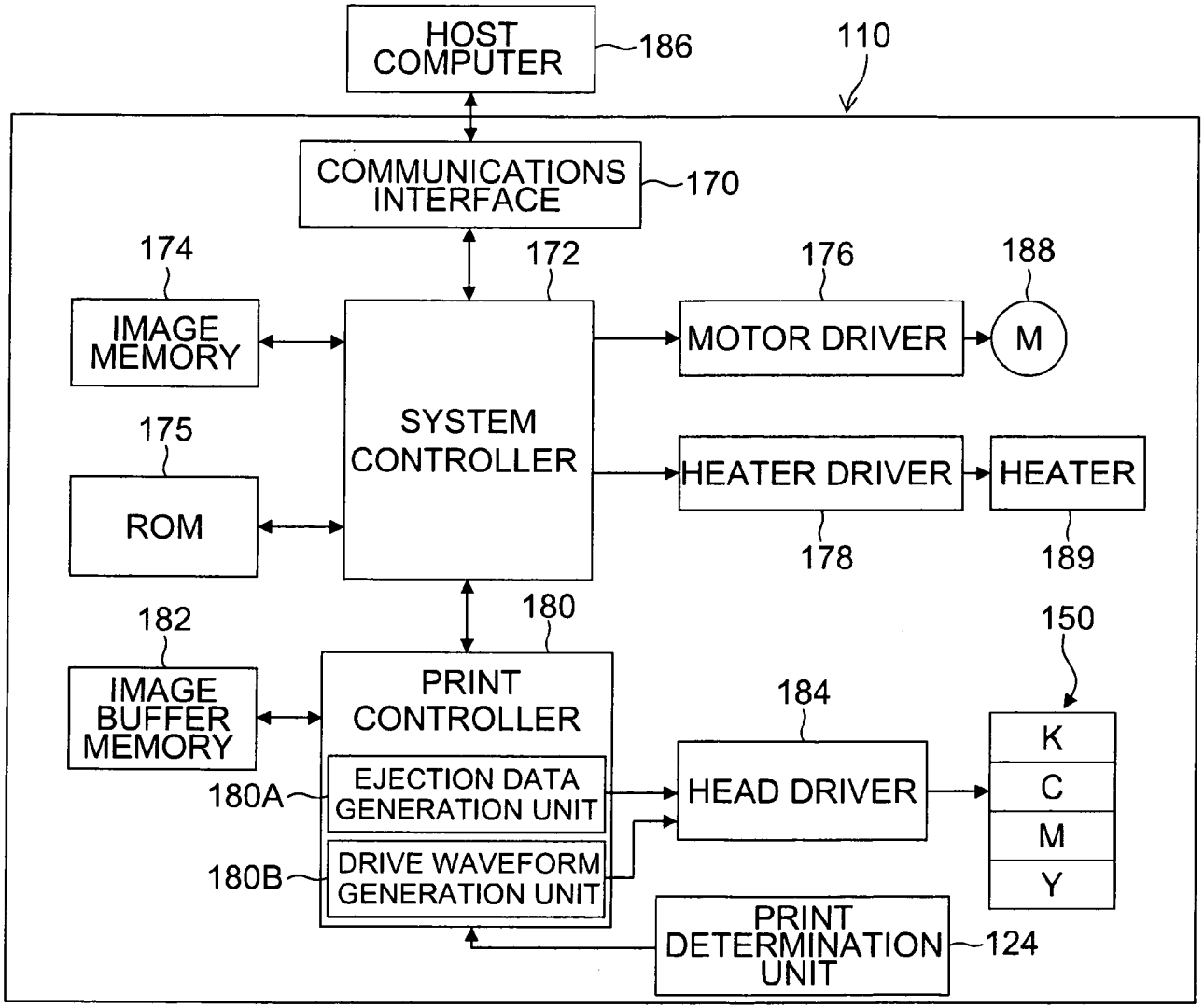
FIG. 12 is a principal block diagram showing the system configuration of an inkjet recording apparatus according to an embodiment of the present invention.

FIG. 12 is a principal block diagram showing the system configuration of the inkjet recording apparatus 110. The inkjet recording apparatus 110 comprises a communications interface 170, a system controller 172, an image memory 174, a motor driver 176, a heater driver 178, a print controller 180, an image buffer memory 182, a head driver 184, and the like.

The communications interface 170 is an interface unit for receiving image data sent from a host computer 186. A serial interface such as USB (universal serial bus), IEEE1394, Ethernet®, wireless network, or a parallel interface such as a Centronics interface may be used as the communications interface 170. A buffer memory (not shown) may be mounted in this portion in order to increase the communication speed. The image data sent from the host computer 186 is received by the inkjet recording apparatus 110 through the communications interface 170, and is temporarily stored in the image memory 174.

The image memory 174 is a storage device for temporarily storing images inputted through the communications interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program. The system controller 172 also functions as a calculation device for performing various calculations. More specifically, the system controller 172 controls the various sections, such as the communications interface 170, image memory 174, motor driver 176, heater driver 178, and the like; controls communications with the host computer 186 and writing and reading to and from the image memory 174; and also generates control signals for controlling the motor 188 of the conveyance system and a heater 189.

The programs executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver 176 drives the motor 188 in accordance with commands from the system controller 172. The heater driver 178 drives the heater 189 of the post-drying unit 142, and the like, in accordance with commands from the system controller 172.

The print controller 180 is a control unit comprising an ejection data generation unit 180A having a signal processing function for performing various treatment processes, corrections, and the like, in accordance with the control implemented by the system controller 172, in order to generate signals for controlling droplet ejection, from the image data (multiple-value input image data) in the image memory 174. The print controller 180 functions as an ejection drive control device which supplies the ejection data (dot data) thus generated to the head driver 184.

The image buffer memory 182 is provided with the print controller 180. Image data, parameters, and other data are temporarily stored in the image buffer memory 182 when image data is processed in the print controller 180. FIG. 12 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is input from an external source via the communications interface 170, and is accumulated in the image memory 174. At this stage, multiple-value RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 174 is sent to the ejection data generation unit 180A of the print controller 180, via the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M, and Y The dot data generated by the print controller 180 in this way is stored in the image buffer memory 182. This dot data of the respective colors is converted into CMYK droplet ejection data for ejecting ink from the nozzles of the head 150, thereby establishing the ink ejection data to be printed.

Furthermore, the print controller 180 also comprises a drive waveform generation unit 180B which generates drive signal waveforms for driving the actuators (reference numeral 158 in FIG. 10) of the head 150, and the signals (drive waveforms) generated by the drive waveform generation unit 180B are supplied to the head driver 184. The signals output from the drive waveform generation unit 180B may be digital waveform data, or may be analog voltage signals.

The head driver 184 outputs drive signals for driving the actuators 158 corresponding to the respective nozzles 151 of the head 150, in accordance with the print contents, on the basis of the ejection data supplied by the print controller 180 (in other words, the dot data stored in the image buffer memory 182, or the CMYK droplet ejection data or ink ejection data to be printed), and the drive waveform signals. A feedback control system for maintaining constant drive conditions for the heads may be included in the head driver 184.

By supplying the drive signals output from the head driver 184 to the head 150 in this way, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled via the head driver 184, on the basis of the dot data generated by implementing prescribed signal processing in the print controller 180, and the drive signal waveforms. By this means, desired dot sizes and dot positions can be achieved.

As described above with reference to FIG. 7, the print determination unit 124 is a block including an image sensor, which reads in the image printed on the recording medium 116, performs various signal processing operations, and the like, and determines the print situation (presence/absence of ejection, variation in droplet ejection, optical density, and the like), and these determination results are supplied to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each pressure chamber 152 of the print head 150, and ejection abnormalities are determined from the determination signals obtained from these pressure sensors when ink is ejected or when the actuators are driven in order to measure the pressure. Alternatively, it is also possible to adopt a mode (external determination method) using an optical determination system comprising a light source, such as a laser light emitting element, and a photoreceptor element, whereby light, such as laser light, is radiated onto the ink droplets ejected from the nozzles and the droplets in flight are determined by means of the transmitted light quantity (received light quantity).

The print controller 180 implements various corrections with respect to the head 150, on the basis of the information obtained from the print determination unit 124 or another ejection determination device (not illustrated), according to requirements, and it implements control for carrying out cleaning operations (nozzle restoring operations), such as preliminary ejection, suctioning, or wiping, as and when necessary.

In the present embodiment, an inkjet recording apparatus having a full line type head is described, but the scope of application of the present invention is not limited to this. For example, the present invention may also be applied to a case where images are formed by using a head of a length which is shorter than the width dimension of the recording medium (the recording paper 116 or other print media), and performing the scanning of the head a plurality of times, as in a shuttle scanning method.

Further Embodiment

Figure 13:
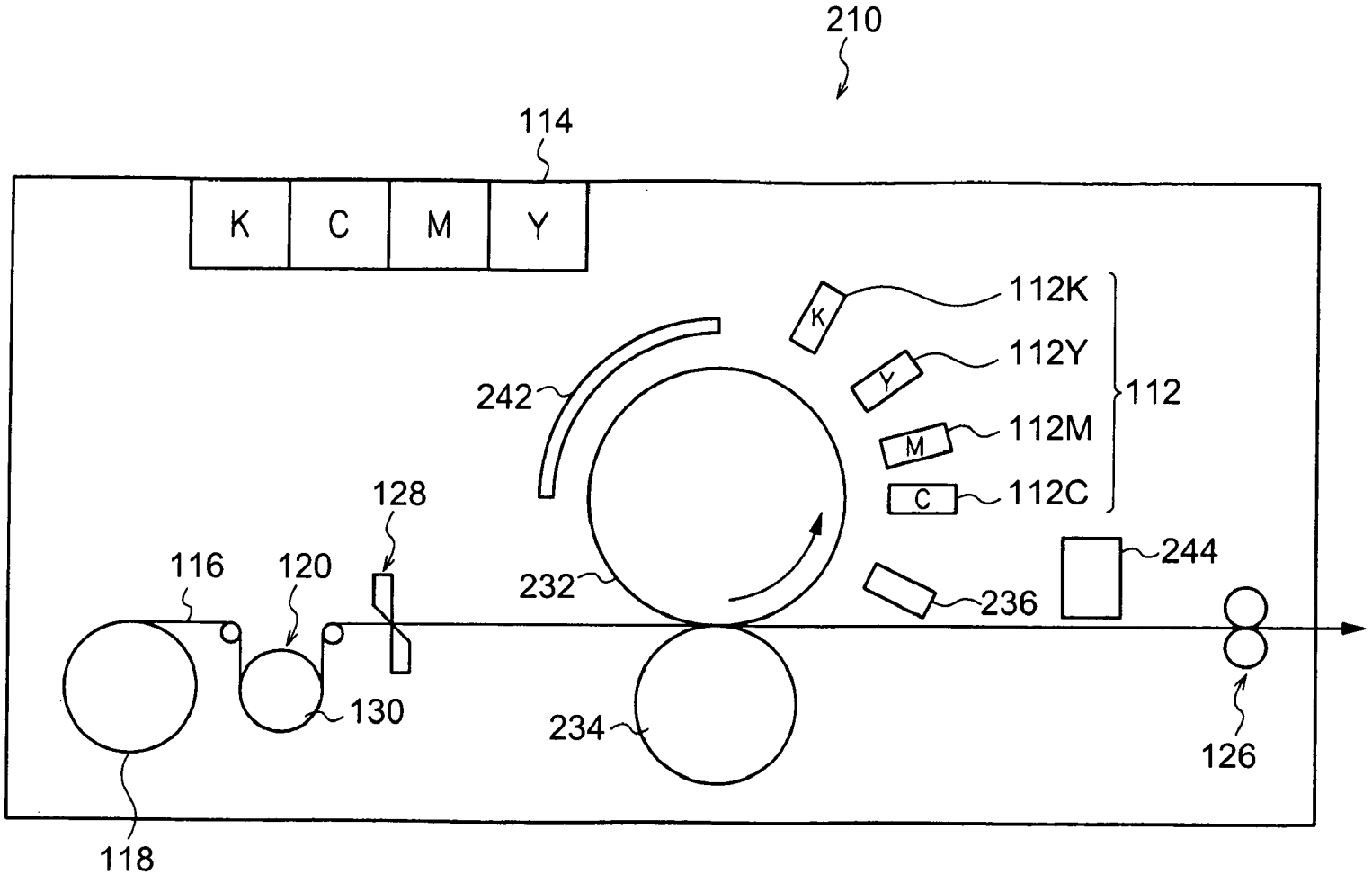
FIG. 13 is a general schematic drawing of an inkjet recording apparatus showing a further embodiment of the image forming apparatus according to the present invention.

FIG. 13 is a general schematic drawing of an inkjet recording apparatus which forms a further embodiment of an image forming apparatus according to the present invention. In FIG. 13, elements which are the same as or similar to the elements in FIG. 7 are labeled with the same reference numerals and description thereof is omitted here.

An inkjet recording apparatus 210 shown in FIG. 13 records an image on the recording paper 116 by forming an image (transfer image) on the surface of an intermediate transfer drum 232 by ejecting inks from heads 112C, 112M, 112Y, and 112K of the respective colors towards the intermediate transfer drum 232, and by transferring the ink from this intermediate transfer drum 232 to the recording paper 116.

The inkjet recording apparatus 210 according to the present embodiment uses ultraviolet-curable ink (UV ink) which undergoes a curing reaction by radiation of ultraviolet-light. The ultraviolet-curable ink is a liquid including a curing initiator, a polymerizable compound and a coloring material (dye or pigment). In implementing the present invention, the ink that can be used is not limited to the ultraviolet-curable ink according to the present embodiment.

As shown in FIG. 13, the inkjet recording apparatus 210 includes a pressurization roller (transfer roller) 234, a cleaner 236, a semi-curing light source 242, and a main curing light source 244.

The intermediate transfer drum 232 is an intermediate transfer body having a cylindrical shape of a length exceeding the maximum width (the width in the direction perpendicular to the conveyance direction) of the recording paper 116, and it is disposed in such a manner that the axis of rotation of the drum coincides with the direction perpendicular to the conveyance direction of the recording paper 116. As shown in FIG. 13, about the periphery of the intermediate transfer drum 232, the heads 112C, 112M, 112Y, 112K corresponding to the inks of the respective colors are disposed in the sequence, cyan (C), magenta (M), yellow (Y) and black (K), from the upstream side, following the direction of rotation of the drum (the counter-clockwise direction in FIG. 13).

The heads 112C, 112M, 112Y, and 112K are full line heads having nozzle rows of a length corresponding to the maximum width (the width in the direction perpendicular to the conveyance direction) of the recording paper 116, and they are disposed in such a manner that the direction of the nozzle arrangement coincides with the direction of the axis of rotation of the intermediate transfer drum 232, namely, the breadthways direction (the perpendicular direction to the surface of the drawing in FIG. 13) of the recording paper 116.

Furthermore, the semi-curing light source 242 is disposed on the downstream side of the intermediate transfer drum 232 in terms of the direction of rotation. The semi-curing light source 242 is a device (semi-curing device) which applies light energy (in this case, ultraviolet light) in order to increase the viscosity of the ink (to provisionally fix the ink on the intermediate transfer drum 232), in such a manner that the ink deposited on the surface of the intermediate transfer drum 232 becomes a liquid of high viscosity, rather than curing completely, and is cured to a semi-cured state in which movement of the liquid does not occur on the surface of the intermediate transfer drum 232.

The pressurization roller 234 is disposed at a position opposing the intermediate transfer drum 232. The recording paper 116 is interposed between the pressurization roller 234 and the intermediate transfer drum 232, and the recording paper 116 is pressed in contact with the intermediate transfer drum 232 at a prescribed pressure while the intermediate transfer drum 232 is rotated in the counter-clockwise direction in FIG. 13 at a circumferential speed which matches the conveyance speed of the recording paper 116. Consequently, the ink is transferred from the intermediate transfer drum 232 to the recording paper 116

When an image has been recorded onto the recording paper 116, the recording paper 116 is conveyed further in the downstream direction. The main curing light source (main curing device) 244 for performing main curing which fixes the image transferred and recorded onto the recording medium 116, is disposed on the downstream side of the intermediate transfer drum 232. By radiating ultraviolet light onto the recording paper 116 from the main curing light source 244, the ink on the recording paper 116 is cured and fixed to an extent whereby image deterioration does not occur during handling in subsequent stages.

Here, the term "handling" indicates, for example, (1) rubbing of the image surface against the rollers, conveyance guides, or the like, in the conveyance steps on the downstream of the main curing device, (2) rubbing between prints in the print stacking section, and (3) rubbing of a finished print against various objects when it is actually handled for use. The term "main curing" indicates curing the liquid droplets to a level whereby no image deterioration is caused by handling of this kind. Therefore, "main curing" does not necessarily means that the curing reaction is completed.

The image is transferred from the intermediate transfer drum 232 to the recording paper 116 as described above, and the image formation region is then cleaned with the cleaner 236. The cleaner 236 is a cleaning device which removes soiling on the surface of the intermediate transfer drum 232 (e.g., residual ink left after transfer, foreign matter, and the like). The cleaner 236 is constituted by a blade which wipes away residual ink while making contact with the surface of the intermediate transfer drum 232, a suction roller which has water-absorbing properties and contains a cleaning solution, or a suction and removal roller which suctions and removes liquid droplets, dirt and other foreign matter from the surface of the drum. The cleaner 236 may be constituted by a suitable combination of these elements.

As shown in FIG. 13, in a method which records an image onto a recording paper by transfer using the intermediate transfer drum 232, the distances (throw distances) between the intermediate transfer drum 232 and the nozzle surfaces of the heads 112C, 112M, 112Y, and 112K are stable; therefore, in comparison with a method (for example, the method shown in FIG. 10) which records an image by ejecting ink directly onto the recording paper 116, each throw distance can be made short without requiring consideration of fluctuations (upward or downward displacement) of the recording paper 116 during the conveyance.

Furthermore, in a head according to an embodiment of the present invention which satisfies the relationship expressed by Formula (5), since the ejection speed is slow, then a liquid column extending from the nozzle section tends to be short. In other words, the distance between the nozzle aperture and a position at which the main droplet is separated from the liquid column tends to be short, which is very suitable for the short throw distance and can further shorten the throw distance.

Thus, with the use of an intermediate transfer system, it is possible to achieve an apparatus composition having a short throw distance, and therefore, it is possible to ensure the droplet deposition accuracy.

In FIG. 13, a drum-shaped member (intermediate transfer roller 232) having a cylindrical (round bar) shape is used as one embodiment of an intermediate transfer medium, but modes of the intermediate transfer medium are not limited to this, and it is also possible to adopt a mode which uses an endless belt-shaped member instead of such a drum-shaped member.

Moreover, the scope of application of the present invention is not limited to the embodiments of the inkjet recording apparatuses 110 and 210 described above. For example, a liquid ejection head according to the present invention may also be applied to a photographic image forming apparatus having a liquid ejection head which applies developing solution, or the like, onto a printing paper by means of a non-contact method. Furthermore, the scope of application of the present invention is not limited to an image forming apparatus, and the present invention may be applied to various other types of apparatuses (e.g., an application device and a wiring pattern printing device) which eject various types of liquids, toward an ejection receiving medium, by means of a liquid ejection head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head comprising an ejection unit which includes:

a nozzle ejecting a droplet of liquid;

a pressure chamber connected to the nozzle;

a displacement generating device which changes a volume of the pressure chamber; and a supply flow channel which is connected to the pressure chamber and supplies the liquid to the pressure chamber, wherein a resonance frequency f (kHz) of the ejection unit and an ejection speed v (m/s) of the droplet which is ejected by the nozzle when the displacement generating device applies pressure change of the resonance frequency f to the liquid at the nozzle, satisfy a following relationship: $f>31\times v+80$.

2. The liquid ejection head as defined in claim 1, wherein the resonance frequency f is not less than 250 (kHz).

3. An image forming apparatus comprising the liquid ejection head as defined in claim 1, wherein the nozzle ejects the droplet onto a recording medium in such a manner that an image including the droplet is formed on the recording medium.

* * * * *